US005358433A

United States Patent [19]

Dechanteloup et al.

[11] Patent Number: 5,358,433

[45] Date of Patent: Oct. 25, 1994

[54] FEMALE ELECTRICAL CONTACT TERMINAL FOR A CONNECTOR

[75] Inventors: Jean-Michel Dechanteloup, le Mans; Patrick Leger, Mulsanne, both of France

[73] Assignee: Framatome Connectors International, Paris la Defense, France

[21] Appl. No.: 73,520

[22] Filed: Jun. 9, 1993

[30] Foreign Application Priority Data

Jun. 9, 1992 [FR] France ..... 92 06914

[51] Int. Cl.[5] ..... H01R 11/22

[52] U.S. Cl. ..... 439/843

[58] Field of Search ..... 439/843, 842

[56] References Cited

U.S. PATENT DOCUMENTS 3,564,487 2/1971 Upstone et al. ..... 439/843

4,687,278 8/1987 Grabbe et al. ..... 439/842

FOREIGN PATENT DOCUMENTS 2596210 9/1987 France .

632503 11/1970 United Kingdom .

*Primary Examiner*—Daniel W. Howell

*Attorney, Agent, or Firm*—Pollock, Vande Sande & Priddy

[57] ABSTRACT

A female electrical contact terminal having a rear tubular shank for connection with an electrical conductor, a forwardly open electrically conductive annular portion for receiving a male terminal, subdivided by a plurality of circumferentially distributed axial slots into a plurality of fingers, each said finger extending axially from a root securely connected to said rear tubular shank up to a free end having an inner swelling, the swelling of all arms defining a male terminal entrance, and a rigid tubular section secured to the roots of the fingers, surrounding the fingers, and limiting radially outwards resilient deformation of the fingers from a free condition of the fingers in which they converge forwardly among from the tubular section. A plurality of such terminal may be located in the insulation of a half-connector.

12 Claims, 2 Drawing Sheets

FEMALE ELECTRICAL CONTACT TERMINAL FOR A CONNECTOR

BACKGROUND OF THE INVENTION

The invention relates to female electrical contact terminals for conveying a high current. The invention is particularly -but not exclusively- suitable for use in electrical connectors that are subjected, in use, to intense vibrations.

There already exist female electrical contact terminals designed to receive a substantially cylindrical male terminal, having a rear shank for connection to an electrical conductor and a forwardly-open annular portion designed to receive the male terminal and subdivided by axial slots, regularly distributed circumferentially, into finger each of which has a radially thickened end so as to present a radially inwardly directed end projection.

By way of example, a terminal described in document FR-A-2 596 210 has fingers which in rest condition define an entrance cross-sectional area that is greater than the cross-section of the male contact, and which are moved inwardly onto the male contact by a slider secured to a movable fraction of an insulation which is urged by a spring towards a position in which it presses the fingers against the male terminal.

That structure has advantages: in particular it reduces the insertion force required for coupling the terminals together. On the other hand, it suffers from the drawbacks of requiring parts which should be moved relative to one another and it is detrimentally affected by severe vibrations.

SUMMARY OF THE INVENTION

It is an object of the invention to provide a terminal of simple structure, capable of maintaining an electrical connection of good quality in spite of vibrations, which does not require movable parts to achieve forced engagement.

To this end, there is provided, in particular, a female terminal of the above defined type which further includes a tubular section secured to the roots of the fingers, surrounding the fingers, and limiting radially outwards resilient deformation of the fingers from a free state of the fingers in which they converge forwardly.

In free or relaxed condition, the radially inwardly directed projections on the fingers define an opening whose diameter is smaller than that of the associated male terminal. If at least the annular portion is made of a material having sufficient resiliency, the contact pressure reduces the electrical resistance between the terminals. The end projections are advantageously designed so that, when the female terminal and the male terminal are fully coupled together, they define a cylindrical bearing surface that increases the area through which electrical current is transmitted. In practice, the cylindrical portion will typically have a length lying in the range $\frac{1}{3}$ to $\frac{1}{2}$ the length of the fingers.

Under such conditions, the electrical current transfer area remains high even in the event of transverse vibrations tending to locally separate the fingers from the male terminal. The contact force may also be sufficiently high to ensure that the male terminal remains in contact with the projections, even under intense longitudinal vibration.

It can also be observed that each finger constitutes a beam securely connected at one end thereof and in abutment at its free end, thereby considerably restricting possible amounts of vibration; the resonant frequencies of such a beam are high, and unlikely to be encountered in normal operation.

In an advantageous embodiment, the female terminal is made up of two portions that are assembled together, the portions being made of metals having different mechanical properties. The shank is then made of a metal that is plastically deformable in order to facilitate crimping by means of a clamp. The "active" annular front portion may be made by lathe machining so as to obtain an annular base which may be press-fit on an extension of the shank having a smaller diameter and an active portion constituted by the fingers which are integral with the base.

The invention further provides an electrical connector comprising a half-connector having a shell containing insulation means with male contacts passing therethrough, each having a groove that is held in an insulating plate, and a half-connector having a shell that can be connected to the shell of the other half-connector, containing insulation means having female contact terminals of the type defined above passing therethrough, each of the male contacts having a cylindrical current portion and being terminated at its front end by a chamfer for easier insertion.

The invention will be better understood on reading the following description of a particular embodiment given by way of non-limiting example. The description refers to the accompanying drawings.

DETAILED DESCRIPTION

Figure 1:
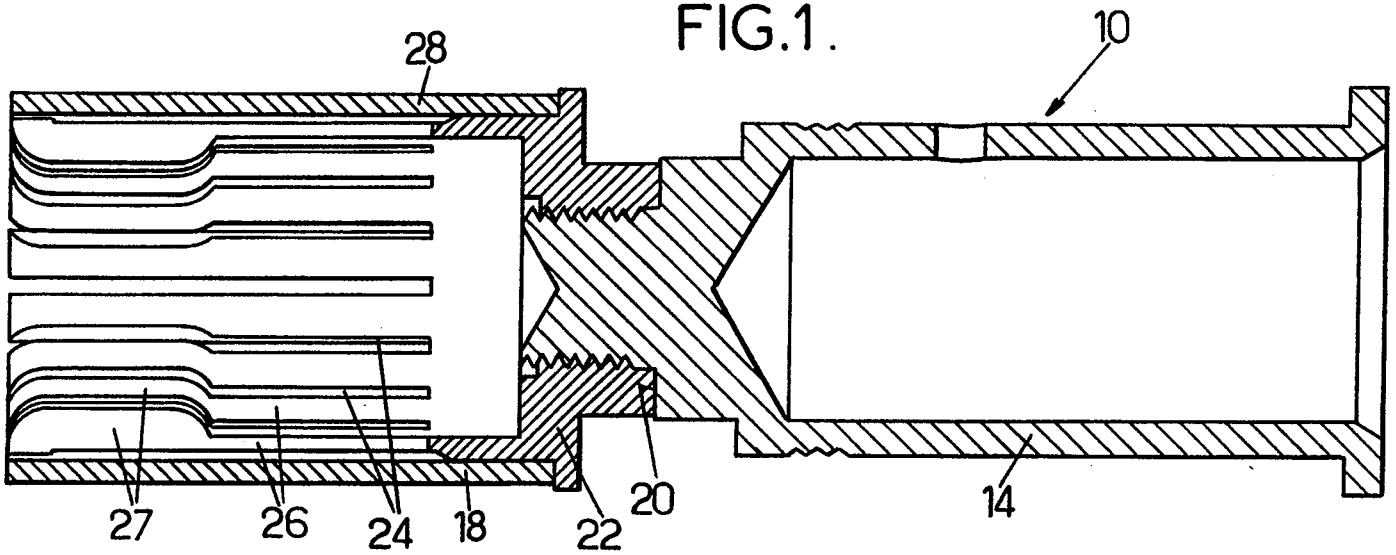
FIG. 1 is a longitudinal cross section through a female terminal on line I-I of FIG. 2.
Figure 2:
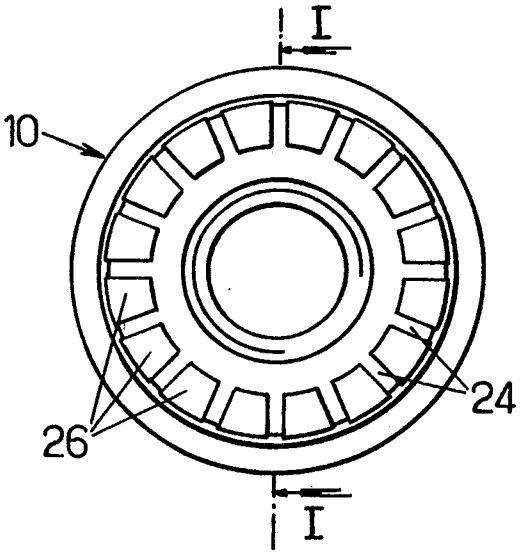
FIG. 2 is a view from the left of FIG. 1.
Figure 3:
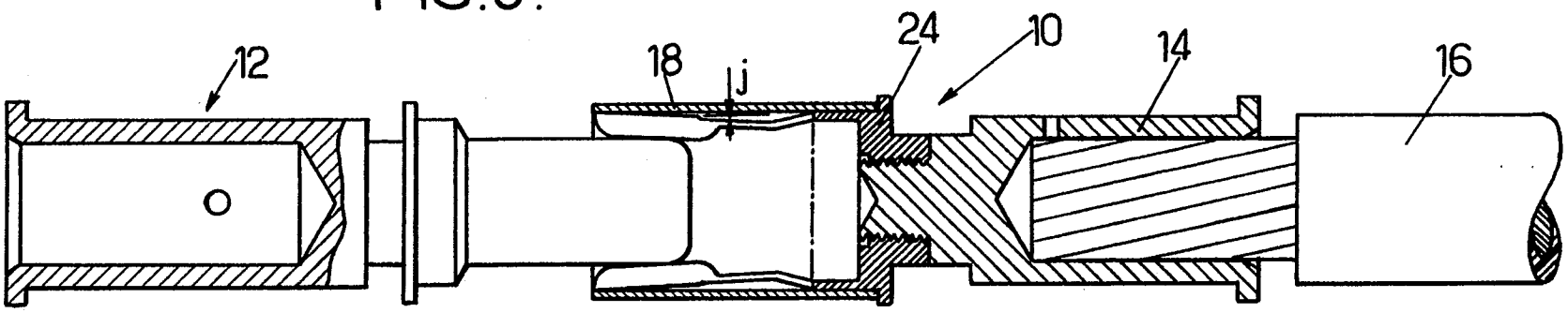
FIG. 3 is an elevational and fragmentary crosssectional view showing a female terminal of the invention and a male terminal in the state they occupy as they begin to be coupled together.

The female contact terminal 10 shown in FIGS. 1 to 3 is for receiving a male terminal 12 having an active portion that is cylindrical and that has an end chamfer for easily penetration into the female terminal.

The female terminal 10 may be considered as comprising a rear shank 14 for connection with an insulated electrical conductor 16, and an active front portion 18. As shown, the two portions are made of different materials and they are subsequently assembled together in permanent manner. The shank 14 may typically be constituted of a material suitable for crimping onto the conductor 16 by squeezing it in two mutually orthogonal directions. In particular, it may be made of machined brass. The shank 14 has a front extension of smaller diameter delimited by a shoulder 20.

The active front portion 18 is, on the contrary, made of a material having a high degree of elasticity, while also providing good electrical conductivity. For example, it may be made of beryllium bronze. It comprises an annular base 22 designed to be permanently secured onto the extension of the shank, e.g. by a press fit. Beyond the base, the front portion constitutes a socket which is split up into a plurality of fingers by regularly distributed slots 24. In practice, the number of fingers will typically lie in the range 12 to 18. A number that is generally satisfactory is 16. The end of the front portion is machined so as to have a thinner intermediate length or section and an end inner projection before it is slotted to form fingers. This provides fingers 36 each having a thin length connected to the base and an end portion with an inner projection 27 that defines a substantially cylindrical inside surface having a diameter that is substantially equal to the diameter of the pin of the male terminal 12 when the fingers are rectilinear. Prior to connection of the front portion with the shank, the fingers are deformed inwardly (FIG. 1) so as to define an entrance passage of a diameter smaller than that of the pin 12.

A continuous tube 28 is mounted on the active front portion. The tube may be press-fit on the common roots of the fingers 26. The tube 28 is designed to operate as a bearing surface for the end fractions of the fingers when the latter are deformed by engaging on a male pin, and it also serves to protect the active portion.

Figure 4:
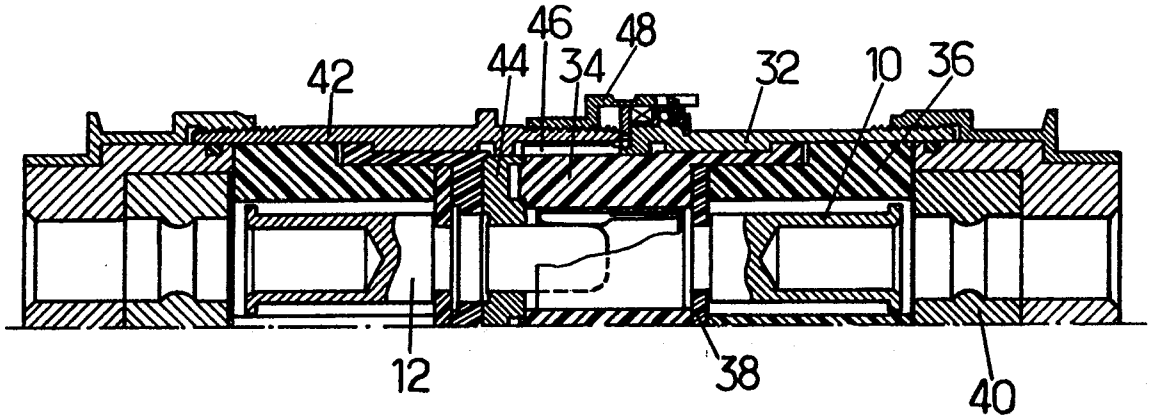
FIG. 4 is a fragmentary longitudinal half-section showing a connector constituting a particular embodiment of the invention and incorporating terminals of the kind shown in FIGS. 1 to 3.

By way of example, FIG. 4 shows a connector suitable for using a female terminal of the kind shown in FIGS. 1 to 3. This connector may be considered as constituted by a male half-connector and by a female half-connector.

The female half-connector includes a shell 23 made up of a plurality of mutually assembled parts that retain insulating means through which the female contacts 10 project.

To retain the female terminals, the insulation means are subdivided into a front insulation plug 34 through which the active portions of the terminals 10 pass, a rear insulation plug 36, and an intermediate washer 38 engaging a circumferential groove in each terminal behind a the active portion, forwardly of the shank. A grommet 40 of flexible elastomer is provided to bear against the conductors and provide sealing.

The male half-connector also has a shell 42 made up of a plurality of mutually assembled parts. The shell contains insulation means which may be similar in structure to the insulation means in the female halfconnector and which retains the male terminals 12, each of which has a groove. The male half-connector may also include a conventional front plate 44 through which contact pins thereof project.

Finally, the half-connectors are provided with cooperating means enabling them to be coupled together with an appropriate angular position, and subsequently to be disconnected. In the example shown in FIG. 4, one of the half-connectors includes at least one rib 46 for sliding engagement into a groove in the other half-connector to provide a slidable keying. The shell of one of the half-connectors carries a ring 48 for screwing onto a thread on the shell of the other half-connector.

The half-connectors are coupled together in conventional manner. When the pin of a male terminal contacts the fingers of a female terminal, its end chamfer acts on the rounded ends of the projections 37 and applies a force that tends to spread them apart and away from the axis. The fingers then deform progressively as insertion proceeds and first take up the shape shown diagrammatically in FIG. 3, with their thin lengths taking up an "S"-shape while the projections remain at an oblique angle relative to the protective tube 28. As insertion continues, the fingers straighten out and end up in the position shown in FIG. 4. A small recess j may be provided on the active portion immediately behind the projections of the fingers so as to leave a clearance, enabling the inside surfaces of the projections to more effectively contact the pin.

It can be seen that each finger thus bears against the associated pin over an area instead of along a circular line only, thereby reducing electrical contact resistance and making it possible to maintain a satisfactory electrical connection even in the event of severe vibration.

We claim:

1. A female electrical contact terminal having:

a rear tubular shank for connection with an electrical conductor, a forwardly opening electrically conductive annular portion for receiving a male terminal, subdivided by a plurality of circumferentially distributed axial slots into a plurality of fingers, each said finger extending axially from a root securely connected to said rear tubular shank up to a free end portion thickened to have a radially inwardly directed projection, the projections of all arms defining a male terminal entrance, and a rigid tubular section secured to the roots of the fingers, surrounding the fingers and shaped to limit radially outward resilient deformation of the fingers from a free condition of the fingers in which they mutually converge forwardly and are each at an increasing radial distance from a tubular wall of the tubular section from the root to the free end thereof.

2. A female electrical contact terminal according to claim 1, wherein said projections are constructed to define a substantially cylindrical surface when said fingers are in radial abutment against said tubular section.

3. A female electrical contact terminal according to claim 2, wherein said cylindrical surface has an axial length comprised between one half and one third of an axial length of the fingers.

4. A female electrical contact terminal according to claim 1, wherein the shank is of a metal that is plastically deformable and the annular portion is of resilient electrically conductive material.

5. A female electrical contact terminal according to claim 4, wherein the shank is of brass and the annular portion is of beryllium bronze.

6. A female electrical contact terminal according to claim 1, wherein said slots are from 12 to 18 in number.

7. A female contact terminal according to claim 3, wherein said slots are from 12 to 18 in number.

8. Electrical connector comprising:

a male half-connector having a first shell, first insulation means in said shell and a plurality of male contact terminals projecting through and retained by said first insulation means, said male contacts having cylindrical end contact portions; and a female half-connector having a second shell connectable to said first shell, second insulation means in said shell, and plurality of female contact terminals for receiving said cylindrical and contact portion, projecting through and retained by said second insulation means, wherein each said female contact terminal has:

a rear tubular shank for connection with an electrical conductor, a forwardly opening electrically conductive annular portion for receiving one said male terminal, subdivided by a plurality of circumferentially distributed axial slots into a plurality of fingers, each said finger extending axially to form a root securely connected to said rear tubular shank up to a free end having a radially inwardly directed projection, the projections of all arms defining a male terminal entrance, and a rigid tubular section secured to the roots of the fingers, and shaped to limit radially outwardly resilient deformation of the fingers from a free condition of the fingers in which they converge forwardly and radially away from the tubular section.

9. Electrical connector according to claim 8, wherein said second insulation means are subdivided into a front insulation plug through which said female terminals project, a rear insulation plug, and an intermediate washer engaging a groove in each said female terminal cut out forwardly of the shank thereof.

10. A female electrical contact terminal having:

a rear tubular shank for connection with an electrical conductor, a forwardly opening electrically conductive annular portion for receiving a male terminal, having a root securely connected to said rear tubular shank and having a free end, said free end having an increased radial thickness to form a radially inwardly direction projection, said annular portion being subdivided into a plurality of fingers by a plurality of circumferentially distributed axial slots extending from said free end; and a rigid tubular section secured to said root, surrounding the fingers and shaped to limit radially outwardly resilient deformation of the fingers from a free condition of the fingers in which said fingers converge forwardly and are each at an increasing radial distance from an inner surface of the tubular section from the root to the free end thereof;

wherein said projection is shaped to define a substantially cylindrical surface, on an axial length comprised between one-half and one-third an axial length of the fingers, when said fingers are in abutment against said inner surface of said tubular section.

11. A female electrical contact according to claim 10, wherein an outer surface of said annular portion is formed with an annular recess which extends lengthwise from immediately behind said radially inwardly directed projections up to the root.

12. A female electrical connector according to claim 10, wherein said rigid tubular section terminates in a same radial plane as said fingers.

* * * * *